US006844500B2

(12) United States Patent
Williams et al.

(10) Patent No.: US 6,844,500 B2
(45) Date of Patent: Jan. 18, 2005

(54) COMMUNICATIONS CABLE AND METHOD FOR MAKING SAME

(75) Inventors: Roger D. Williams, Middleton, ID (US); Darren V. Young, Nampa, ID (US)

(73) Assignee: ConectL Corporation, Boise, ID (US)

( * ) Notice: Subject to any disclaimer, the term of this patent is extended or adjusted under 35 U.S.C. 154(b) by 0 days.

(21) Appl. No.: 10/338,352

(22) Filed: Jan. 6, 2003

(65) Prior Publication Data

US 2003/0132022 A1 Jul. 17, 2003

Related U.S. Application Data

(60) Provisional application No. 60/346,599, filed on Jan. 7, 2002.

(51) Int. Cl.[7] ..... H01B 11/00

(52) U.S. Cl. ..... 174/110 R; 174/113 R; 174/117 F

(58) Field of Search ..... 174/102 R, 103, 174/105 R, 106 R, 107, 36, 110 R, 112, 113 R, 117 R, 117 F, 117 FF

(56) References Cited

U.S. PATENT DOCUMENTS

| | | | | | |
|---|---|---|---|---|---|
| 3,600,500 | A | * | 8/1971 | Schoerner et al. | 174/115 |
| 3,735,022 | A | | 5/1973 | Estep | |
| 3,800,065 | A | * | 3/1974 | Bunish et al. | 174/115 |
| 4,308,421 | A | * | 12/1981 | Bogese, II | 174/32 |
| 4,313,029 | A | * | 1/1982 | Bunish | 174/115 |
| 4,383,725 | A | * | 5/1983 | Bogese et al. | 439/391 |
| 4,404,424 | A | | 9/1983 | King et al. | |
| 4,551,576 | A | | 11/1985 | Rich | |
| 4,642,480 | A | | 2/1987 | Hughes et al. | |
| 4,663,098 | A | * | 5/1987 | Gilliam et al. | 264/104 |
| 4,680,423 | A | | 7/1987 | Bennett et al. | |
| 4,707,568 | A | * | 11/1987 | Hoffman et al. | 174/103 |
| 4,777,325 | A | * | 10/1988 | Siwinski | 174/34 |
| 4,800,236 | A | | 1/1989 | Lemke | |
| 5,025,115 | A | * | 6/1991 | Sayegh et al. | 174/117 F |
| 5,162,611 | A | * | 11/1992 | Nichols et al. | 174/36 |
| 5,180,890 | A | * | 1/1993 | Pendergrass et al. | 174/117 F |
| 5,428,187 | A | * | 6/1995 | Crane et al. | 174/36 |
| 5,485,488 | A | | 1/1996 | Van Brunt et al. | |
| 5,503,155 | A | | 4/1996 | Salmon et al. | |

(List continued on next page.)

FOREIGN PATENT DOCUMENTS

| | | | | |
|---|---|---|---|---|
| DE | 32 24 596 | A * | 12/1983 | H01B/7/08 |
| EP | 0066910 | A * | 12/1982 | H01B/7/08 |
| JP | 01-105406 | A * | 4/1989 | H01B/7/08 |
| JP | 1-267908 | A * | 10/1989 | H01B/7/08 |
| JP | 03-226917 | A * | 10/1991 | H01B/7/08 |
| JP | 2002-216551 | A * | 8/2002 | H01B/11/12 |

OTHER PUBLICATIONS

Belkin USB2 Gold Series; 1 Page; Belkin.Com.
Belkin USB2 Pro Series; 1 Page; Belkin.Com.
USB Cable Technical Specifications; 1 Page.
How Firewire Works; 4 Pages; http://www.howstuffworks.com/firewire.htm/printable.
How USB Ports Work; 6 Pages; http://www.howstuffworks.com/usb.htm/printable.
IEEE 1394; 2 Pages; http://www.pcworld.com/resource/printable/article/0,aid,14371,00.asp.

* cited by examiner

*Primary Examiner*—William H. Mayo, III
(74) *Attorney, Agent, or Firm*—Frank J. Dykas; Dykas, Shaver & Nipper

(57) ABSTRACT

A flat communication cable is provided having one or more pairs of data conductor wires, which are single wires as opposed to twisted pairs, with each pair of conductors co-extruded and encased within an inner jacket. Shielding is provided around the inner jackets and encased within an outer jacket together with appropriate power leads and drain lines.

28 Claims, 2 Drawing Sheets

U.S. PATENT DOCUMENTS 5,767,441 A 6/1998 Brorein et al.
5,796,042 A 8/1998 Pope
6,215,071 B1 4/2001 Kasahara et al.
6,218,621 B1 4/2001 Kuczynski
6,232,557 B1 * 5/2001 Lounsbury et al. ..... 174/117 F
6,254,924 B1 7/2001 Brorein et al.
6,255,593 B1 7/2001 Reede
6,286,294 B1 9/2001 Suzuki
6,304,476 B1 10/2001 Liao
6,318,062 B1 11/2001 Doherty
6,337,444 B1 1/2002 Liao
6,362,432 B1 * 3/2002 LaPidus et al. ..... 174/113 R
6,410,845 B2 6/2002 Reede
6,444,902 B1 * 9/2002 Tsao et al. ..... 174/36

COMMUNICATIONS CABLE AND METHOD FOR MAKING SAME

PRIORITY

This application incorporates by reference and claims priority, as a continuation in part, from provisional application Ser. No. 60/346,599, filed on Jan. 7, 2002, entitled Improved Data Communications Cable.

BACKGROUND OF THE INVENTION

1. Field of the Invention

The present invention generally relates to data communications cables, and more particularly relates to electrical communications/data cabling, which is formed of single, multi-strand wire conductors, as opposed to twisted pair conductors, in a flat, as opposed to round, configuration.

2. Background Information

In Universal Serial Bus (USB) specification cables, the properties of the cable must be adapted to carry information in accordance with the outlined specifications for the particular cable, as well as to comply with the adapter plugs that accompany USB outlets. These specifications include, amongst others, desired or required transmission rates or bandwidths, voltage ratings, temperature ratings, insulation resistance, conductor resistance or impedance at specified temperatures. In some USB cables, shielding is provided and the conductors are generally configured of four wires, arranged in two insulated, twisted pairs of data transmission signal wires. Typically, these wires are twisted pairs of data transmission wires made of 26 or 28 American Wire Gauge (AWG). Usually another two wires are included, the first is a power wire and the second is a power ground wire, both typically 24 AWG. The power wire is usually designed to provide 500 milliamps at 5 Volts from a computer to a peripheral device, and can handle a maximum of 30 Volts rms. Higher quality USB cables, which include twisted, paired conductors and shielding, are generally capable of data transmission rates of 12 Mbps. A polypropylene thread sealer is filled around the four wires, including the two pairs of twisted conductors and the two power wires, thereby forming a round, cross-sectional shape, which is an easy shape for extrusion and wrapping with a shield. Higher quality cables are typically double shielded and include an aluminum foil/Mylar and a wrap shield, which is then covered with a copper alloy braid. Lesser quality cables typically contain only one shield. A 28 AWG drain wire may also be present. The drain wire is in conductive contact with the outer shield and is used to dissipate radio frequency interference (RFI) and electromagnetic interference (EMI). The outermost shield is then covered with polyvinyl chloride or other sheathing material. In general, these high transmission rate USB cables have a round, cross-sectional configuration.

There is another specification for USB cables wherein no shielding is provided. These cables do not incorporate twisted pairs of data transmission conductors, and as a result the communications rating is much, much lower, typically around 1.4 Mbps.

A recent standard promulgated by the USB Board is the USB 2.0 standard. This type of cable can handle high-speed device transmission data rates as high as 480 Mbps. A typical round USB cable, conforming to the USB 2.0 includes double shielded twisted pairs of conductors wire as shown in Prior Art FIG. 1. As can be seen in Prior Art FIG. 1, two twisted pairs of wires, which are used as the data conductors, along with power lines 1 and 2 encased within a round jacket formed of polypropylene thread. A circular configuration is used to facilitate easier placement of shielding and extrusion of the outer jacket. The prior art cable of FIG. 1 includes a jacket wrapped around each wire of the twisted pair conductors and around both power wires. Two additional layers of shielding are provided around the inner jacket of polypropylene thread, the first is usually an aluminized foil, and the second a braided shield. All of this is, in turn, encased within an outer jacket.

A second type of data communications cable commonly available is one that complies with a set of standards promulgated by the Institute of Electrical and Electronic Engineers (IEEE). These are the IEEE 1394 and IEEE P1394 standards for data cables in common use today. The properties of this cable must be adapted both to carry information in accordance with the outlined specifications, as well as to comply with the adapter plugs that accompany IEEE 1394 outlets. IEEE 1394 cable is generally configured to have two power wires and four data conductors, all of which are insulated. The four data conductors are each comprised of a pair of twisted wires, typically 26 or 28 AWG. The other two wires constitute a power wire and a power ground wire, typically 24 AWG. The power wires are utilized to power the component connected to the cable. In some embodiments, the component has its own source of power and does not need a cable having power wires. In such an embodiment, a cable containing only four pairs of twisted wires may be used. The conductors and the power wires are bundled together much the same as is shown in Prior Art FIG. 1 for a USB cable. A polypropylene thread filler is filled around the four conductors, and the power wires, if provided, thereby form a round, cross-sectional shape, which is easier for extrusion and wrapping with a shield. Higher quality cables are typically double shielded with an aluminum foil/Mylar wrap shield, which is then covered with a copper alloy braid. Lesser quality cables contain only one shield. A 28 AWG drain wire may also be present. The outermost shield is then covered with PVC or other sheathing. Cables manufactured to IEEE 1394 specifications usually have a round, cross-sectional shape. Like USB 2.0, IEEE 1394 data transmission cables can have quite high transmission, up to 400 Mbs.

There are some basic problems or drawbacks with each of these prior art cables. The first is that there is some manufacturing problems associated with control over impedance characteristics. The first is control of wall thickness for the insulating jackets encasing each of the wires in the twisted pair before they are twisted together. The second problem is controlling matched lengths of wires when they are being twisted, and the third is that twisted pairs, when flexed or bent, have a tendency to separate from each other. All of these issues affect impedance.

Next, are the costs and time required in the manufacturing process for the additional step of fabricating the twisted pairs of conductor wires prior to fabrication of the cable. The second is the generally round, cross-sectional configuration of each of these cables. While the data transmission characteristics and transmission rates for cables manufactured to these specifications can, and are routinely met, round, sectional shaped cables have certain inherent limitations regarding their use. The primary limitation of the round cable is the fact that it is not amendable to being wound around a spool in a tight, compact configuration. A better configuration would be a shielded flat electric cable such as that is disclosed in the patent to King (U.S. Pat. No. 4,404,424), which issued Sep. 13, 1983. However, the problem with the cable disclosed in the King patent is that it still has the manufacturing drawbacks of the twisted pair configuration for the conductor wires.

An ideal cable would be a flat, shielded data transmission cable that meets all of the required data transmission specifications and rates, but which does not require the twisted pairs of conductor wires. In practice, it has been found that a four fold increase in production rates for data transmission cables can be achieved by co-extruding two conductor wires in parallel spaced relationship to each other, as opposed to individually coating each wire and twisting the two wires of each twisted pair together. This results in substantial manufacturing cost savings.

An additional benefit of the present invention is that a flat cable can be compactly wound around a spool such as those disclosed in U.S. Pat. Nos. 5,655,726 and 5,797,558.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

Accordingly, it is an object of this invention to provide a data transmission cable that will meet the specifications for USB 1.1, USB 2.0, IEEE 1394, IEEE P1394, as well as any future cable specifications that may be promulgated and adopted in the industry, with a cable that is formed in a flat configuration and does not utilize twisted pairs of wires as data conductors.

These objects are achieved in improved data cable compliant with the USB 2.0 specifications, which has a flat configuration and does not utilize twisted pairs of wires as conductors. The new USB cable is provided with a pair of multifilament, single wire conductors encased within an inner jacket having high dielectric strength. The wires may be formed of various copper and cadmium alloys. They are co-extruded simultaneously with the inner jacket and are held in parallel spaced relationship at a specified distance from each other and at a specified distance from the outside surface of the inner jacket. In this manner, accurate impedance levels can be achieved.

The inner jacket is then encased within a foil shield. The foil shield may be formed of aluminized foils or may be formed by spraying, painting, wiping, or otherwise coating the inner jacket with a coating having at least one conductive metal therein and thereafter allowed to dry.

Thereafter, the inner jacket and first shield are then wrapped with a braided outer shield, which may also serve as a drain line. Power leads are then provided and all are encased in a generally flat configuration within an outer jacket.

IEEE 1394 data transmission cables can be formed in a similar manner with each cable having multiple pairs of conductors with each encased within an inner jacket and each appropriately shielded. Power lines may also be provided and all of this may be encased within a generally rectangular shaped outer jacket. Double shielding for the inner jackets and their encased pairs of conductors may be provided by additional shielding wraps around each separate inner jacket, or the inner jackets may be positioned adjacent to each other with one larger outer shield to encase them all. Separate drain lines may be provided, or the outer shield may serve as the conductive drain line.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
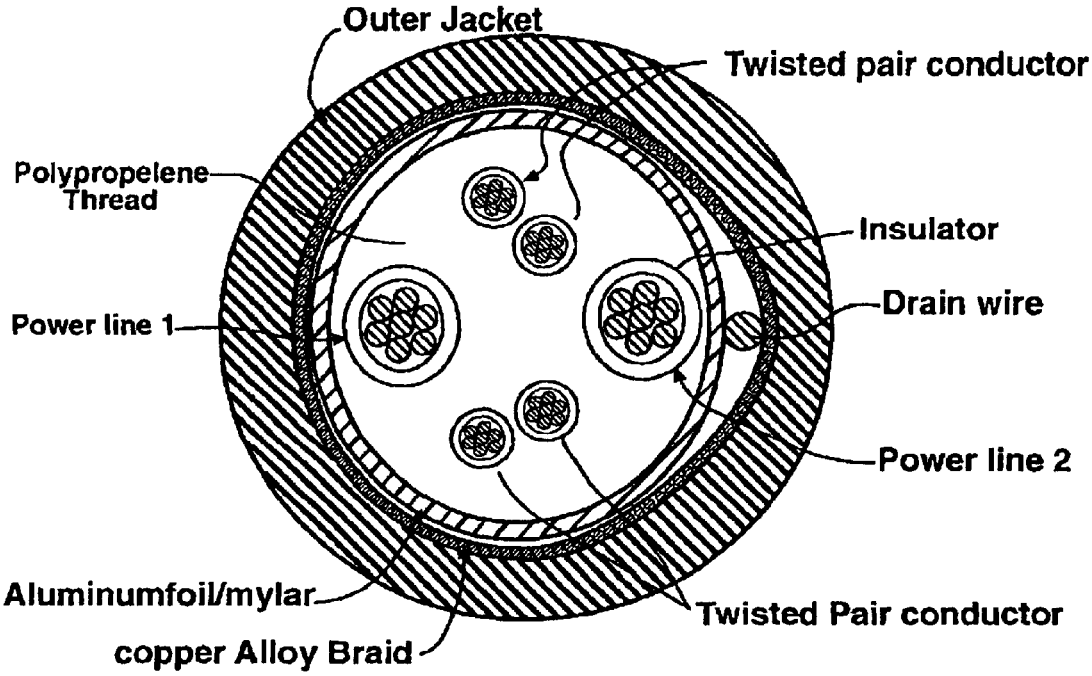
FIG. 1 PRIOR ART
FIG. 1 is a representational, cross-sectional view of a prior art USB cable.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Figure 2:
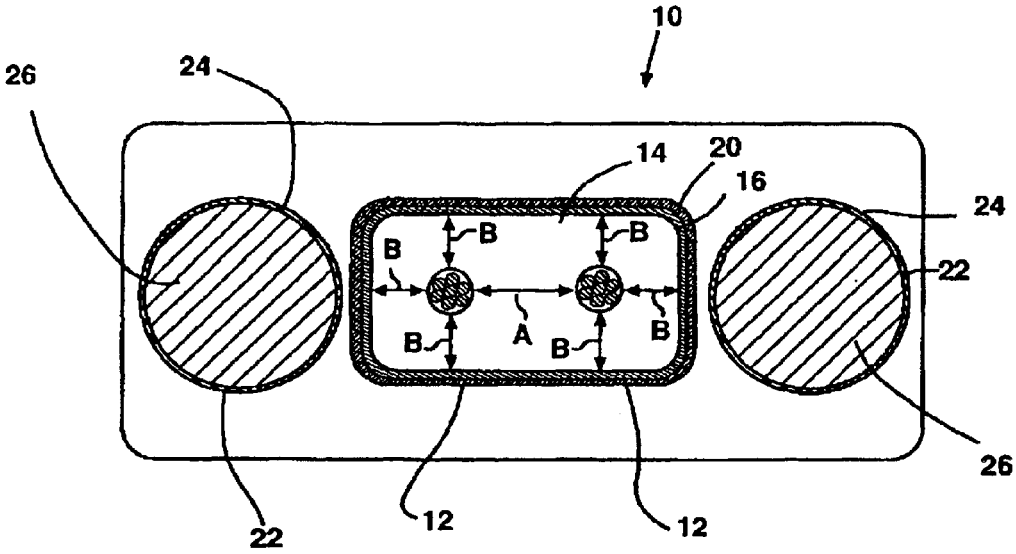
FIG. 2 is a representational, cross-sectional view of the new flat USB cable.

FIG. 2 is a representational, cross-section view of the configuration of the new, invented USB cable that has a flat configuration and does not utilize twisted pairs of wire conductors. At the heart of the new cable 10 is a pair of multifilament, single wire conductors 12 encased within inner jacket 14. The conductors 12 are, in the preferred embodiment, 30 AWG and are composed of multiple strands of tinned copper, with each conductor having a diameter of 0.012 inches. The inner jacket is formed of a high dielectric material, which, in the preferred embodiment, is a high density polyethylene.

The conductors can be formed of various alloys of copper and cadmium. However, tinned copper is the preferred material for the conductors. In practice, it has been found that if the conductor is comprised of many small strands of copper, as opposed to fewer large strands, the conductor is much more flexible. The inner jackets can be formed of various polymers such as: polyolefins, polyamides, polyurethanes, and polyvinyl chlorides. However, in practice, it has been found that the use of polymers with a higher dielectric strength, such as polyolefins and polyamides, make it possible to manufacture a cable with a smaller cross section due to the reduced amount of material required between the conductors.

In order to maintain the specified data transmission rates within the cable, it is critical that the impedance of the cable be matched to that required by the specifications. In practice, it has been found that correct impedance, and thus adequate transmission rate capability, can be achieved by adjusting the distance, shown as Referenced Dimension A in FIG. 2, to carefully space the two conductors 12 apart from each other during a co-extrusion process with the material of the inner jacket. Additionally, another critical feature is the distance between the outside diameter of each cable 12 to the outer edge of the inner jacket 14 as shown by Referenced Dimension B in FIG. 2. In practice, using the materials of the preferred embodiment, accurate impedance levels can be achieved, and thus data transmission rates can be maintained at adequate levels by spacing apart, in a parallel arrangement, conductors 12 at a distance from each other of 0.018 inches, when encased within high density polyethylene. In addition, the jacket is sized so as to make Referenced Dimension B normal to the tangent portion of the round conductor 12 to the outer edge of the inner jacket 14 at a distance of 0.010 inches.

It should be distinctly understood that the actual dimensions disclosed herein are only representative of the preferred embodiment. They will change to achieve different impedance levels using the same materials, and obviously must change if the conductor wires and/or the inner jacket are made from other materials. While it may be possible to calculate these dimensions for various conductive materials used for the wires and dielectric materials used to form the inner jacket, to achieve the desired data transmission rates and impedance levels, it is generally easier to start with a good estimate and empirically set the actual dimensions through iterate analysis by running tests on various designs actually tested.

The inner jacket 14 is then encased within a foil shield, which in the preferred embodiment is a 0.0015 inches thick aluminized Mylar or polyester. In the preferred embodiment, this is the wrap foil that is wrapped at 5.5 wraps per inch, with a minimum of 25% overlap. This inner shield 16 is then self encased within a braided shield 20, which, in the preferred embodiment, is a spiral wrap of thirty two strands of wire having a 0.003 inch diameter or any other number of wires of a different diameter so that the sum of all the strands is equivalent to a 28 AWG stranded conductor. The spiral wrap in the preferred embodiment provides for a minimum of 65% coverage, and also serves as a drain line for any induced currents.

There are other methods of providing for the inner shield 16, which are at least as good as the shield provided in the preferred embodiment. These include the use of what are known as inks or coatings, which are applied in liquid form and contain a conductive metal of some sort. These inks or coatings can be sprayed, painted, wiped or squeegeed on. The inner jackets can also be dipped in these conductive coatings to provide an inner shield coating.

The power leads 22 are provided, and, in the preferred embodiment, are 24 AWG multi-strand tinned copper with an uncoated diameter of 0.024 inches. The power leads are, together with the inner jacket 14 and shields 16 and 20 are then extruded and encased within outer jacket 26, which, in the preferred embodiment, is made of urethane. The power leads need not be individually insulated as the outer jacket 26 does provide adequate insulation. However, according to current USB standards, they need to be color coated in some manner, and as a result, in the preferred embodiment, power leads 22 are each encased within insulative jackets formed of FEP with a thickness of 0.0045 inches. One power lead is black and the other is red. In this preferred embodiment, a cable conforming to USB standards to for USB-2 is formed in a rectangular, cross-sectional configuration having dimensions of approximately 0.062 inches high and 0.154 inches wide. This results in a reduction of cross-sectional area of approximately 67% over most round USB cables found in the prior art. In other words, the new flat communications cable described herein is much smaller than most, if not all, prior art USB compliant cables.

This cable is at least as flexible as the USB cable having twisted pairs of wires for conductors, and has the additional benefit of a miniature size and the flat configuration that greatly facilitates the ability to wrap this cable in a spiral such as that is found within retractor coils.

While what is shown in FIG. 2 and described above is a preferred embodiment, there are a number of alternative materials and processes that can be used to provide essentially the same flat cable that does not require the use of twisted pairs of wires as conductors. For example, there are a number of suitable materials for use in forming the inner jackets 14 that have suitable dielectric characteristics. These include other vinyls such as polyvinyl chloride (PVC), polyolefin, and floropolymer resins, such as FEP, as well as other materials including non-halogen compounds having the desired dielectric properties. In each case, given the properties of the selected materials, the extrusion process may have to be modified to vary the Reference Dimensions A and B to produce the proper impendence for the desired data transmission rates and capabilities. Additionally, the shielding is that described in FIG. 2 may be varied. The inner shield can also be formed of conductive coatings in the form of conductive ink, paint, adhesive, powder coatings, paste, and polymers applied by being sprayed on, dipped, brushed, baked, dusted or extruded. Tinsel foil may also be used, as well as metal tape, laminated shield tape of polymeric material and metal. It can also be applied as a helical wrap, as in the preferred embodiment, or as a "cigarette" wrap, as multiple strands in overlapping, longitudinal configurations, or even as conductive fibers.

The outer shield in a like manner can be formed from a variety of the same above-listed materials and may further include braided or wrapped strands of wire or conductors. In addition, a separate drain line, not shown in FIG. 2, but shown in FIG. 4 may be provided.

The outer jacket material may also be selected from a variety of materials such as polyurethane, thermal plastic elastomers, fluorocarbons, nylon, and other aerometric fibers.

Hence, the description of the preferred embodiment should be considered as illustrative only. The key element is the dimension of the inner jacket 14 and the spacing of the conductors 12 within it relative to each other, and also to the outer edge of the inner jacket, and thus to the inner shield.

This spacing can be achieved using high quality extrusion equipment that feeds the conductors 12 into the extrusion die where the inner jacket materials flow between the two conductors 12 and provide for uniform spacing along the length of the entire cable. Such equipment is known to exist in the industry and basically the process resembles that which is typically used for forming by extrusion the typical wire utilized in the standard household extension cord.

It should also be noted that the cable described in FIG. 2 conforms to USB-2 specifications. Cables of lower quality can be made that also embody the specifics of the present invention. These include the elimination of outer shield 20 and, in specialized cases, the removal of power leads 22. Also, a USB cable could be formed that eliminates both the inner shield 16 and the outer shield 20. However, in such a case, the cable would have much lower data transmission rate capabilities.

Figure 3:
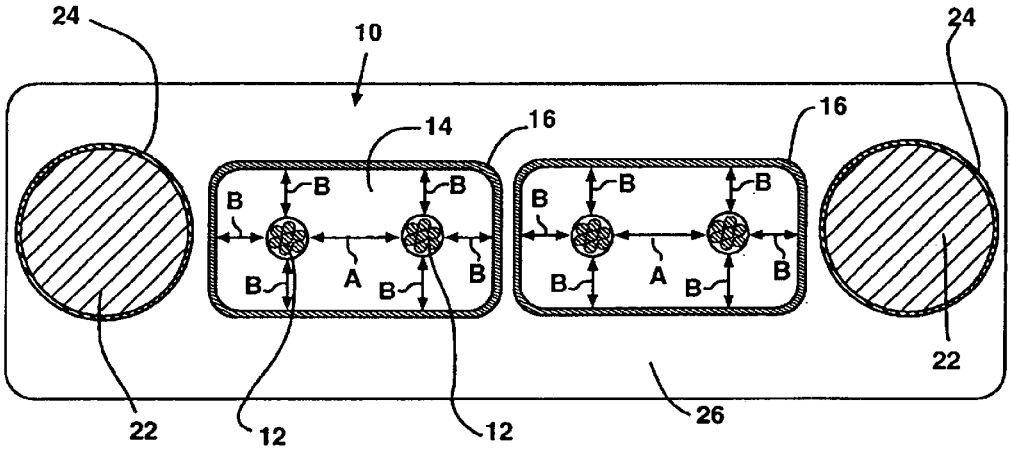
FIG. 3 is a representational, cross-sectional view of a first embodiment of a new flat IEEE 1394 cable.

Referring to FIG. 3, there is shown a first embodiment of a new flat cable in a typical IEEE 1394 configuration. In this configuration, the cable includes a pair of inner jackets 14 encasing conductors 12 in much the same manner and utilizing the same materials and general dimensions as those disclosed and shown for the USB cable of FIG. 2. Like the USB cable of FIG. 2, power leads 22 are encased within jackets 24 are also provided. All of this is encased within an outer jacket 26 formed of essentially the same materials as that described in the embodiment shown in FIG. 2. This embodiment shows only one shield 16 provided around the inner jacket 14.

In addition to what is described above, in the embodiment shown in FIG. 3, drain wires 18 are also provided for reduction and removal of any induced currents. The drain wires run along the longitudinal direction of the shielded conductors on the outside or the inside of the conductive shields. The drain can conduct through the shielding to eliminate radio frequency interference, as well as electromagnetic interference.

Like the embodiment shown in FIG. 2, the same variety of different materials may be used to form the cable.

Figure 4:
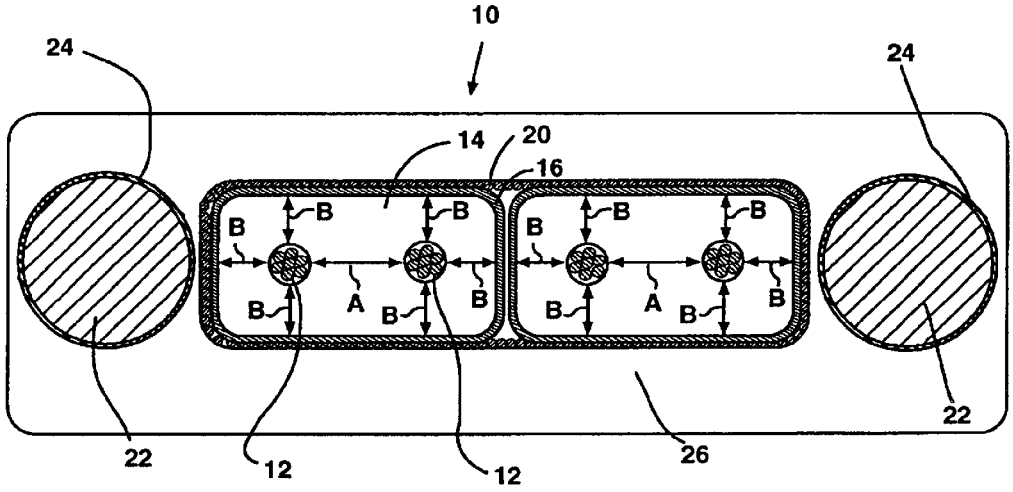
FIG. 4 is a representational, cross-sectional view of a second embodiment of a new flat IEEE 1394 cable.

Now referring to FIG. 4, there is shown a second embodiment of a cable conforming to IEEE 1394 specifications. This cable provides for the pairs of conductors 12 encased within inner jackets 14 to be positioned adjacent to each other. In this case, each inner jacket 14 is wrapped within a first shield 16 as described above for the USB disclosed above and shown in FIG. 2. Shields 16 are positioned in contact with each other during the extrusion process for the outer jacket 26. Also provided is drain conductor 18, which runs longitudinally between and adjacent to both inner shields 16 and in a conductive relationship with both of them. All of this is then encased within an outer shield 28. This assembly is then extruded into outer jacket 26 along with a pair of power leads 22. Again, the selection of materials for each of the various component parts of the cable is essentially the same as that described in the embodiment shown in FIG. 2, and likewise, certain features of cables may be omitted depending on the requirements for usage of the cable, including the outer shield 28 and the power leads 22.

The cables produced pursuant to the present invention provide a generally rectangular, cross-sectional configuration and are particularly suitable for use in coiled applications such as found with retractor cord assemblies such as those described in U.S. Pat. Nos. 5,655,726 and 5,797,558. Also, the cross-sectional area of the cables of the present invention are smaller than that typically found in the cross-sectional area of a round cable. Given there flat, rectangular shape, additional beneficial uses are found in connecting various component pieces of hardware together where the configurations of the hardware require smaller, flatter cables to be installed.

It should be distinctly understood, that the present invention is not limited to the specific cable specifications identified above. The present invention is applicable to any cable used for data transmission. It should also be understood that applications to which the present invention may be applied is not limited to those enumerated above. The inventive principles of the present invention may be used in cables to many other applications.

Regarding cable flexibility, the cables of the present invention appear to be more flexible than those cables within the prior art if for no other reason other than the reduced cross-sectional area of the cables when compared to the prior art.

Also, in practice, it has been found that the elimination of the use of twisted pairs of wires as conductors as indicated, eliminate the following steps from the manufacturing process: the creation of the twisted pairs, the coating of the twisted pairs with conductive coatings to facilitate good transmission capabilities, and individual shielding of the twisted pairs, thus achieving significant costs savings and reduced manufacturing time.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

We claim:

1. A communications cable which comprises:

a pair of multifilament data conductor wires of a type other than a twisted pair conductor wires;

an inner jacket formed of a first dielectric material encasing said multifilament data conductor wires at a predetermined distance from each other, and in juxtaposed relationship to each other, and at a predetermined distance from the outer surface of said inner jacket, to achieve a pre-selected impedance level for said conductor wires;

an outer jacket of a second dielectric material encasing said inner jacket; and first electrical shielding material positioned between the outer jacket material and the inner jacket material and encasing the outer surface of said inner jacket.

2. The communications cable of claim 1 which further comprises a pair of power leads positioned on opposite sides of said inner jacket and in the plane defined by said pair of conductor wires, said power leads also encased within said outer jacket.

3. The communications cable of claim 1 wherein said first dielectric material is selected from the group which includes polyolefins and polyamides.

4. The communications cable of claim 1 wherein said second dielectric material is selected from the group which includes polyurethanes, polyvinyl chlorides, polyamides and elastomeric polyolefins.

5. The communications cable of claim 1 wherein said first and second dielectric materials are each selected from the group which includes elastomeric polyolefins, polyamides polyurethanes and polyvinyl chlorides.

6. The communications cable of claim 1 wherein said outer jacket is formed in a generally rectangular cross-sectional configuration.

7. The communications cable of claim 1 wherein said first electrical shielding material is a coating, which includes at least one conductive metal, and which is either wrapped, sprayed, painted, spread or dipped upon said inner jacket.

8. The communications cable of claim 1 which further comprises second electrical shielding material positioned between the outer jacket material and the first electrical shielding material and encasing said first electrical shield.

9. The communications cable of claim 8 wherein said first electrical shielding material is a coating, which includes at least one conductive metal, and which is either wrapped, sprayed, painted, spread or dipped upon said inner jacket.

10. The communications cable of claim 8 wherein said second electrical shielding material is selected from the group which includes braided and wrapped conductive wires.

11. The communications cable of claim 9 wherein said first dielectric material is selected from the group which includes polyolefins and polyamides.

12. The communications cable of claim 9 wherein said second dielectric material is selected from the group which includes polyurethanes, polyvinyl chlorides, polyamides and elastomeric polyolefins.

13. The communications cable of claim 9 which further comprises a pair of power leads also encased within said outer jacket.

14. The communications cable of claim 9 wherein said first and second dielectric materials are each selected from the group which includes elastomeric polyolefins, polyamides, polyurethanes and polyvinyl chlorides.

15. A communications cable which comprises:

a plurality of pairs of multifilament data conductor wires;

a plurality of inner jackets formed of a first dielectric material, each encasing a pair of said multifilament data conductor wires at a predetermined distance from each other, and in juxtaposed relationship to each other, and at a predetermined distance from the outer surface of said inner jacket, to achieve a pre-selected impedance level for said conductor wires;

a plurality of outer jackets of a second dielectric material encasing said inner jackets; and first electrical shielding material positioned between the outer jacket material and the inner jacket material and encasing the outer surface of each of said inner jackets.

16. The communications cable of claim 15 which further comprises a pair of power leads also encased within said outer jacket.

17. The communications cable of claim 15 wherein said first dielectric material is selected from the group which includes polyolefins and polyamides.

18. The communications cable of claim 15 wherein said second dielectric material is selected from the group which includes polyurethanes, polyvinyl chlorides, polyamides and elastomeric polyolefins.

19. The communications cable of claim 15 wherein said first and second dielectric materials are each selected from the group which includes elastomeric polyolefins, polyamides, polyurethanes and polyvinyl chlorides.

20. The communications cable of claim 15 wherein said first electrical shielding material is a coating, which includes at least one conductive metal, and which is either wrapped, sprayed, painted, spread or dipped upon said inner jacket.

21. The communications cable of claim 15 which further comprises a pair of power leads also encased within said outer jacket.

22. The communications cable of claim 15 which further comprises second electrical shielding material positioned between the outer jacket material and the first electrical shielding material and encasing said first electrical shield.

23. The communications cable of claim 22 wherein said first electrical shielding material is a coating, which includes at least one conductive metal, and which is either wrapped, sprayed, painted, spread or dipped upon said inner jacket.

24. The communications cable of claim 22 wherein said second electrical shielding material is selected from the group which includes braided and wrapped conductive wires.

25. The communications cable of claim 24 wherein said first dielectric material is selected from the group which includes polyolefins and polyamides.

26. The communications cable of claim 24 wherein said second dielectric material is selected from the group which includes polyurethanes, polyvinyl chlorides, polyamides and elastomeric polyolefins.

27. The communications cable of claim 24 which further comprises a pair of power leads also encased within said outer jacket.

28. The communications cable of claim 24 wherein said first and second dielectric materials are each selected from the group which includes elastomeric polyolefins, polyamides, polyurethanes and polyvinyl chlorides.

* * * * *